United States Patent [19]

Takats et al.

[11] 4,366,095

[45] Dec. 28, 1982

[54] PROCESS AND EQUIPMENT FOR THE TRANSPORTATION AND STORAGE OF RADIOACTIVE AND/OR OTHER DANGEROUS MATERIALS

[75] Inventors: Ferenc Takats; Ferenc Lóránd; Imre Pajer; László Lipták, all of Budapest, Hungary

[73] Assignee: Eroterv Eromu es Halozattervezo Vallalat, Budapest, Hungary

[21] Appl. No.: 178,351

[22] Filed: Aug. 15, 1980

[30] Foreign Application Priority Data

Sep. 14, 1979 [HU] Hungary ..... EO 361

[51] Int. Cl.[3] ..... A45C 11/20

[52] U.S. Cl. ..... 252/633; 206/584; 250/506.1

[58] Field of Search ..... 252/633; 206/521, 548, 206/524.3; 250/506

[56] References Cited

U.S. PATENT DOCUMENTS

| | | | |
|---|---|---|---|
| 1,408,757 | 3/1922 | Metzger | 206/584 |
| 3,608,495 | 9/1971 | De Mare | 206/584 |

FOREIGN PATENT DOCUMENTS

| | | | |
|---|---|---|---|
| 2916381 | 4/1978 | Fed. Rep. of Germany | 250/506 |
| 4219557 | 5/1963 | Japan | 250/506 |

*Primary Examiner*—Brooks H. Hunt
*Attorney, Agent, or Firm*—Young & Thompson

[57] ABSTRACT

With the aid of the process and equipment according to the invention, the transportation and storage of radioactive and/or other dangerous materials are realizable in accordance with the domestic and international regulations. The physical and radiation protection of the objects to be transported or stored are ensured by the dry, granular material (e.g. sand) filled into the equipment. Loading and removal of the objects are facilitated with fluidization of the granular material. The equipment includes gas distribution system, filter supported by lumpy material pressed between the grids, through which gas (e.g. air) is blown, whereby the granular material is fluidized. The object(s) is (are) positioned by a basket of lattice construction, its fastening dependent on the embodiment. The equipment has fixable cover, withdrawable dustproof cover, ribs for improving the cooling and for partical absorption of the forces arising at impacts. At the transport equipment the basket is closed with lattice lid and the level of granular material is controlled by a trough. At the storage equipment the cooling of the object is ensured with gas flowing in the space between the container and storage shaft. The invention may be used also for the safe transportation and storage of radioactive waste materials (burnt out heating elements).

13 Claims, 2 Drawing Figures

Figure 1:
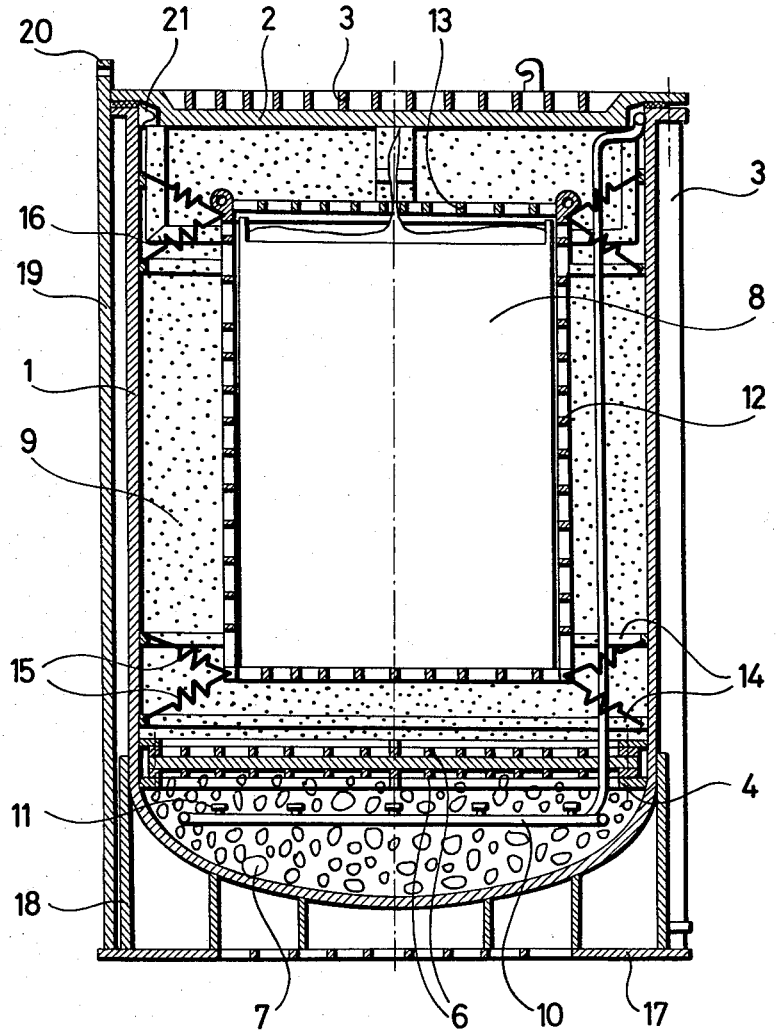

PROCESS AND EQUIPMENT FOR THE TRANSPORTATION AND STORAGE OF RADIOACTIVE AND/OR OTHER DANGEROUS MATERIALS

The invention relates to a process and equipment for the transportation and storage of radioactive and/or other dangerous materials, in the course of which the (radioactive) object(s) is (are) stored in a container filled with granular material. Purpose of the granular material is to ensure the physical- and radiation protection of the radioactive object(s).

Several processes and types of equipment exist for the transportation and storage of the radioactive materials. The types of equipment used for transportation and storage generally differ from each other.

Generally thick-walled, well-sealed metal vessels (containers) are used for the transportation of the radioactive materials and for the protection of the material to be transported. The hermetically closed vessel (safety tank) containing the radioactive material is stored in this container. There are several requirements concerning the transportation mode of the radioactive and especially the high-activity materials. According to the substance of the requirements the container should ensure adequate physical (mechanical, thermic, etc.) and radiation protection for the safety tank containing the radioactive material both under normal circumstances and in the course of various accidents which might occur during transportation.

The container is subjected to various, specific tests, imitating the effects arising during accidents. The successfully tested container type—being in compliance with the transport regulations—are classified. The essential tests are the following:

drop test onto concrete surface from the height of 9 m and onto drift from the height of 1.20 m;

fire resistance test at 800° C. for ½ hour;

water resistance test, when the consignment submerged in water is subjected to a pressure corresponding to 15 m depth of water.

During and after the tests only an insignificant amount of radioactive material may escape into the surroundings, furthermore the system should preserve its radiation protection capability. Meeting the various requirements makes the construction of the container very difficult. From the point of view of the traditional technical solution—i.e. the thick-walled container—these requirements are partially contradictory. In fact—due to the radiation protection requirements—the wall thickness and weight of the container will increase with the amount of activity to be transported. In this case however, the resistance against the dynamic effects (drop tests) as well as against the heat effect will deteriorate. The greater is the wall thickness of the container, the higher stresses will arise in case of dynamic force effect and heat effect. In the interest of eliminating the indicated problem, the heavy containers are made in multi-layered construction.

A soft metal layer—e.g. lead—is used between the outer and inner steel layers of the house, whereby the dynamic stresses are reduced. In spite of this even the containers with laminated wall have several adverse properties:

(a) the container is generally regarded as a target equipment, in which an object of specific size and maximized activity can be transported;

(b) since the object (safety tank) to be transported is situated in the air space within the container, if activity of the consignment is high—and as a result its internal heat evolution is also high—the dissipation of heat is difficult and the active material is subjected to heating;

(c) in case of high external heating during the fire resistance test, the metal container conducts the heat toward the safety tank, the container due to its low thermal capacity does not give sufficient thermic protection and the active material in the safety tank is subjected to intensive heating;

(d) the forces of inertia arising from the weight of the safety tank during the dynamic effects (impacts) can be transferred to the container only in a complicated way and imperfectly, in other words the kinetic energy of the safety tank is practically consumed by the tank itself through its deformation, thus the possibility of damages exists;

(e) production of the multi-layered heavy containers—which are dimensioned for the transportation of material with large volume and high specific activity—is complicated, requiring high grade machine manufacturing preparations and accordingly the containers are extremely expensive.

The mentioned disadvantages—first of all the high cost—are reduced to a certain extent by those solutions, when a certain part of the radiation protection of the container is ensured by the inorganic granular material in the compartments mounted on the metal body, instead of by the metal body itself of the container, Such solution is described in a lecture (IAEA-SM-147/4) published in the seminary of NAÜ "Packing and tests for the transportation of radioactive materials" (Vienna, 8–12 February, 1971). Its author is W. R. Taylor, title: "Planning and development of packing fuel bundles of low activity". According to the described solution the inner side of the container is covered with plate divided into compartments, vermiculite charge being in the compartments. However, this solution is recommended only for fresh fuel of very low activity. The fixed arrangement of the inner filling material in the compartments does not reduce the technical disadvantages mentioned in points (a)–(d) to any considerable extent.

The most generally accepted method of storing the high-activity materials—e.g. burnt off fuel—is the storage of the active material in a basin filled up with water.

In underwater storage the water ensures the radiation protection of the active material. At the same time it enables the relatively simple manipulation of the active material (loading, unloading), since it ensures the cooling of the water and the radiation protection even during the time of the process. Apart from the many advantages of the underwater storage, it has several problemes, which are particularly unfavourable in the course of storing the burnt off fuel:

(a) The cover of the material stored under water—e.g. burnt-off fuel—is subjected to corrosion. In case of corrosion damage the soluble radioactive materials under the cover pass into the water, and the gaseous substances pass into the air space of the basin (e.g. fissions in the gas gaps below the cover of the burnt off heating elements).

(b) Due to the radioactive pollution, the water requires continuous purification, air space of the basin is to be ventilated. Purification of the exhausted air is necessary, while the cooling of the water is solved with forced circulation.

Due to the intensive gamma-radiation, the water suffers radiolitic decomposition, and the arising oxyhydrogen has to be checked and disposed.

(d) Cost of the storage is increased by the necessity of using expensive structural materials in the basin—mainly stainless steel—furthermore in the interest of safety, the principle of double waterproof tank has to be applied. (The actual storage tank is surrounded by a second insulated concrete tank.)

(e) The underwater storage basin is sensitive to external effects. Should the water flow out—either because of the defective equipment or due to catastrophic natural disaster—the high-activity radioactive material remains without radiation protection and cooling. This causes significant radiation danger in the surroundings.

The process and equipment according to the invention are based on the recognition that the transportation and storage of radioactive and/or other dangerous materials placed in a container filled with fluidizable, dry, granular material are safer and less expensive than in the solutions known so far. The invention is aimed at eliminating the shortcomings of the previous solutions. The following disadvantages of the transport equipment can be eliminated by realization of the present invention:

due to the high heat capacity of the container and to the heat insulating effect of the granular charge, the consignment endures the fire test more easily, heating of the interior is low;

in case of dynamic effects (impact), the decisive part of the kinetic energy of the safety tank is not taken up by itself, but by the granular charge, thus the inner tank is less sensitive to damage;

production is simpler and less expensive than that of the multi-layered, heavy containers.

The equipment storing the high-activity radioactive materials using the process according to the invention eliminates the following disadvantages:

corrosion of the cover and its consequences;

necessity of purifying the medium absorbing the radiation;

development of oxyhydrogen;

the sensitivity to damage is reduced and at the same time the danger of the stored material being left without radiation protection;

no need for double watertight container.

The radiation protection and physical protection of the emissive material during transportation and storage of the radioactive materials are solved by placing them into container filled with dry granular material. The simple, remote-controlled loading and unloading of the emissive material is made possible by blowing gas (e.g. air) into the bottom of the container for the duration of the process, which penetrates the dense sieve (made of thick felt, or sintered bronze) and fluidizes the granular charge above it, the said sieve being built in above the air distributor system. (The granular material is called sand in the following, not limiting the sense of the word to the generally known quartzsand, but extending it optimally to dry, rounded fragments of loose material, the grain size of which is suitably about 0.1–1 mm.)

If uniformly distributed gas (e.g. air) is blown through the granular material with a speed exceding the limiting speed of the fluidization, but lower than the pneumatic conveying speed, then the friction between the grains diminishes to such low extent that the friction between the grains becomes fluid, i.e. it behaves as liquid. In this case the objects of higher specific weight than the volume weight of the sand, will submerge without obstruction by their own weight. After stopping the air current, the fluid condition to ceases to exist, and the object immersed into the sand is fixed by its high internal friction. The object is removed similarly by fluidization of the sand with air blast. The immersed object is removable from the fluidized sand without obstruction.

Cooling of the transported and/or stored objects as necessary, is ensured by the suitable formation and arrangement of the container in such a way, that the developed heat is dissipated by the natural or artificial circulation of gas (e.g. air).

The suitable embodiments of the equipment realizing the process according to the invention—based on the principle of fluidized granular protection—for the transportation and storage of radioactive materials differ from each other in several respects, hence these two embodiments are described separately.

The vertical section of a possible embodiment of the container based on the fluidized granular protection is shown in FIG. 1. The main parts of the container: the container body 1 and cover 2. The container is a cylindrical steel vessel with embossed bottom. Its characteristic diameter is 1–3 m, height 1.5–4 m depending on the size of the consignment and on the radiation protection requirements. Its characteristic wall thickness is 10–20 mm. The container is closed with a flat—incidentally embossed—cover, fixed with collar screw, sealed on the top. The container and cover are covered with shock protective ribs 3 spaced at not over 150 mm. Purpose of these ribs is to take up part of the impact energy in case of impact, and distribution of the concentrated force effect onto a larger surface in case of dropping onto a drift, and thereby reducing the deformation of the container. In case of high-activity consignment with intensive heat development the ribs improve the external, natural air cooling of the container. The filter 5 at the bottom of the container is built onto the supporting flange 4 in sealed and removable condition, the material of which may be felt or other flexible filter material with high air resistance. The desirable air resistance is 0.5–1 kPa at 3 cm/sec air velocity. The filter is supported at the top and bottom by a light grid 6 of steel construction. Its purpose is not load bearing, but preventing the filter from deformation (bulging) when air is blown in.

The filter statically is supported by the bed 7 of lumpy material (e.g. gravel bed) in the bottom of the container. The fluidizing air filters through the gravel bed, while the gravel bed itself facilitates the uniform air distribution. In addition to this it has a radiation and physical protective role similarly to the sand 9 surrounding the object 8 to be protected. Its grain size has to be much larger than that of the sand, thus it does not start moving during the air blast, and it does not clog up the injecting heads 11 on the air distributor 10. Characteristic grain size of the gravel bed is 3–5 mm.

The object 8 to be transported in the container is fixed by the sand after its fluidization is stopped, however, during transportation to the effect of vibration the inner friction of the sand may decrease and the parcel may shift in it. This is prevented by placing the parcel into a lattice basket, closed similarly with a lattice lid 13. The lattice basket is freely penetrated by the sand. The basket is flexibly fixed to the inner reinforcing frame 14 of the container 1 with the aid of supporting springs 15 protected with rubber bell. During intensive dynamic force effects (impact) the flexible fastening of the basket enables the movement of the protected object in the sand, whereby the kinetic energy is taken up by the sand, instead of the basket, or container. Under normal transportation conditions the basket fixes the parcel, furthermore it facilitates its central arrangement, positions the object when it is placed in.

The central arrangement is necessary for the equivalent protection in every direction. The container is suitable for the transportation of one or several objects of various size—assuming that there is room for them in the basket. Due to the different sizes of the objects, the sand level varies after it is filled in. In order to prevent this, a circular levelling trough is provided on the upper part of the container, into which the superfluous sand may flow over the rim of the levelling trough. After removal of the parcel the sand in the levelling trough can be returned through the valves into the container.

Following the loading the container is closed with cover 2, which fixes the sand from above. The container is set on base 17 either on the ground or on the transport vehicle, which base is connected to the container 1 with skirt 18. Three supporting columns 19 with lifting lugs 20 at the ends running along the container and connected to the base are provided for lifting the container. The container is lifted with the cross rod hooked into the lifting lugs.

The process of loading the container is the following:

cover 2 removed;

dustproof cover 21 pulled out, which expands as a harmony, whereby the container is lengthened; (The dustproof cover prevents the sand from flowing out, as well as the fitting plane of the container cover from getting sandy.)

the sand is fluidized with air blast, in the interest of which the hose at the end of the air injection device is attached to an external compressor. The necessary amount of air projected to the cross section of the container is about 120 $m^3/hm^2$, resistance of the system equals the hydrostatic pressure of the sand layer + the resistance of the distributor device. (Generally 50–100 kPa overpressure is sufficient for the usual transportation dimensions.);

lid of the basket is opened;

the parcel to be transported is lowered;

lid of the basket is closed with the aid of lock and key;

the air current is stopped;

if necessary the surface of the sand is levelled with hand tool;

the end of the supporting cord of the parcel to be transported is hooked into the lug of the levelling trough;

the extending part of the air hose is adjusted and fixed;

the dustproof cover is pushed back;

the cover is replaced and the container is closed.

Figure 2:
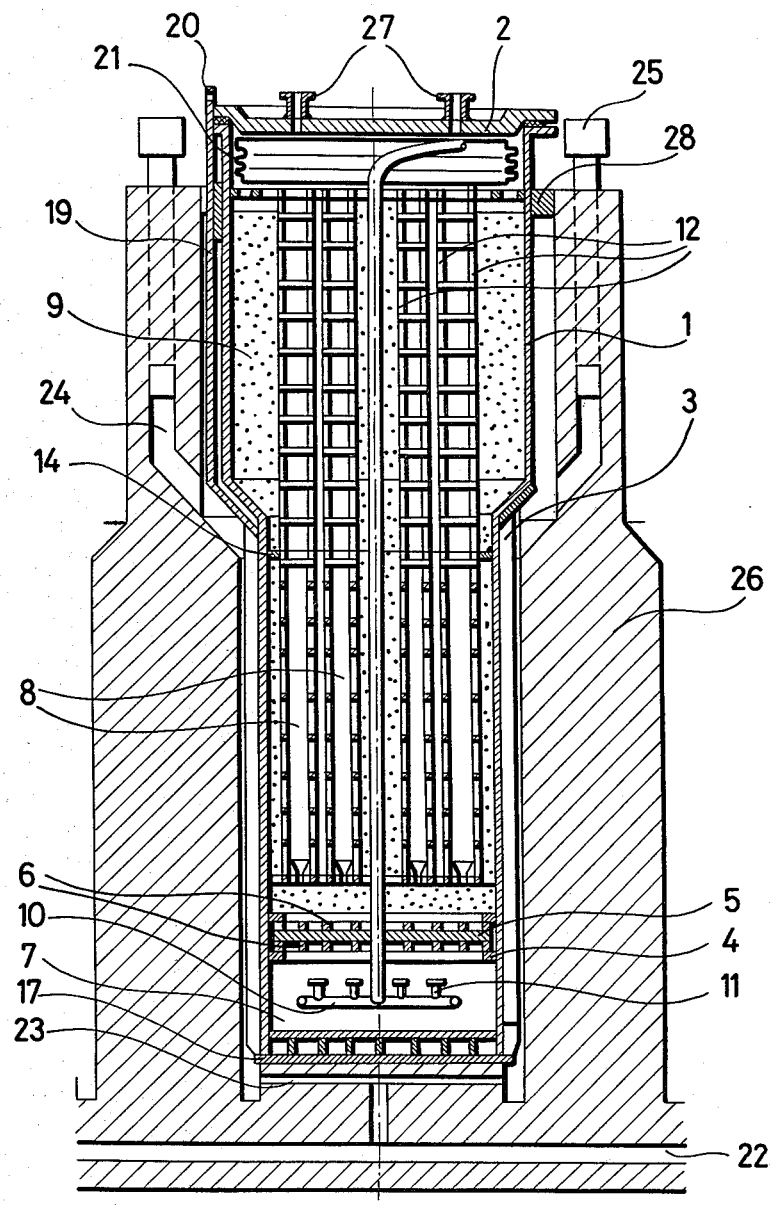

Removal of the transported parcel is similar. A possible embodiment of the equipment for storage according to the invention is shown in FIG. 2, where the vertical section of the storage container with fluidizable granular protection for the storage of high-activity materials (e.g. burnt off fuel) is illustrated by way of example.

The storage container is essentially the same as the embodiment for transportation (transport container), but due to the different requirements concerning transportation and storage, part of the structural elements is different. The main differences are the following:

the storage container is not subjected to the dynamic force effects, hence the structural elements for fastening the object and for positioning and fixing the container are simplified;

the storage container is for the storage of relatively high-activity objects, where the heat dissipation requires intensive cooling due to the radioactive disintegration, which has to be taken into consideration at positioning of the container;

the storage container is generally not used individually, but several of them are arranged in the store building in concrete shafts (cells) of module system, and in this case the concrete structure of the storage shafts supplements the radiation protection of the storage container.

Main parts of the storage container: container body 1 and cover 2. The container is a cylindrical vessel with flat bottom, assembled from a lower cylinder of smaller diameter and upper cylinder of greater diameter.

The characteristic diameter of the lower cylindrical part: 0.5–1.5 m, and diameter of the upper part: greater by 0.2–0.5 m. Characteristic length of the container 4–7 m. The dimensions are selected according to the size and activity of the radioactive abject(s) to be stored. The container is closed on the top with a sealed cover 2 ditted with collar screw.

Two stubs 27 are arranged on the cover for the periodical blow-by, when checking the activity of the air space below the cover. The objects to be stored are arranged in the smaller cylindrical part of the storage container. For this reason this part of the container is sensitive, thus it is provided with longitudinal impact-protective ribs 3, spaced at maximum 150 mm. Due to the relatively intensive heat development of the high-activity objects arranged in the storage container, the ribs have an increased role in solving the external cooling.

The supporting flange 4 at the bottom of the container fixes the filter 5 in sealed condition, but in a removable way, said filter being made of flexible material (e.g. thick felt) with high air resistance. Its resistance is suitably 0.5–1 kPa, at 3 cm/sec air velocity. Bending and bulging of the filter is prevented by the lower and upper grid 6 of light steel construction. The filter statically rests not on the lower grid, but on the gravel bed 7 filling in the space at the bottom of the container and the gaps of the grid. The fluidizing air flowing through this gravel bed will be more uniformly distributed. In addition, the gravel bed—similarly to the sand 9 surrounding the objects to be stored—has radiation and physical protection function as well. The characteristic grain size of the gravel bed is to be 3–5 mm, since this way it can not shift, and it does not clog up the injecting heads 11 on the air distributor 10. The object(s) 8 to be stored is (are) fixed by the sand after cessation of the fluidization, but the place of fixing is not indifferent.

Due to the intensive heat development and gamma-radiation, the distance of the objects from the wall of the container and from each other must be controlled. For this purpose are the basket(s) 12 used matching the shape of the object(s) to be stored, which is (are) of lattice construction, thus the sand freely penetrates it (them). Arrangement and positioning of the objects are ensured by guiding the baskets when placing in the objects.

Bottom of the storage container is formed by base 17, which is sufficiently solid to carry the load of the full container equally when it is lifted or standing on it. The storage container is lifted with the cross rod hooked into the lifting lugs 20, mounted on the three vertical supporting columns 19. The storage containers are set up in concrete shafts 26. The integral concrete shafts of the storage containers arranged next to each other form a cell structure, which has extremely high strenght in horizontal direction.

Cooling of the container and material within is ensured by the air flowing in the space between the concrete shaft and container. The air passes through the air inlet ducts 23 at the bottom of the concrete shaft into the space between the concrete shaft and storage container.

The air flows through the air distributor 22 formed in the floor below the concrete shafts, to the inlet ducts.

The cooling air is not conducted through the gap, since it is closed with packing 28 on the top, but through the zig-zag air outlets 24 formed in the wall of the concrete shaft. These outlets are connected to the cooling air-collectors 25. The zig-zag line of the cooling air outlets 24 prevents dispersion of the gamma-radiation. By pulling out the dustproof cover 21, the height of the storage container will be increased, thus the sand can not flow out even in fluidized condition.

Loading of the objects 8 to be stored into the container and their removal take place the same way as in the processes carried out at the transport container.

We claim:

1. Process for the transportation and/or storage of radioactive and/or other dangerous materials, characterized by arranging the radioactive object(s) 8 in a container 1 filled with granular material 9, where the loading of the radioactive object(s) into the container or their removal are facilitated with fluidization of the granular material.

2. Process as claimed in claim 1 for the transportation and/or storage of radioactive and/or other dangerous materials, characterized by ensuring the cooling of the container 1 when necessary in such a way, that by its external shape and/or arrangement it is made suitable to dissipate the developing heat with the natural or artificial circulation of gas.

3. Transport and/or storage equipment for implementation of the process as claimed in claim 1 characterized by having a filter 5 fitted between grids 6 and resting on the supporting flange 4 at the bottom of the container 1 closed with cover 2 and provided with ribs 3, and by blowing gas below the filter 5 through the gas distributor 10 and injecting heads 11, the granular material 9 above will be brought into fluidized condition.

4. Transport and/or storage equipment as claimed in claim 3 characterized by having lumpy material 7 supporting the filter 5 in the bottom of the container within the space between the gas distributor 10 injecting heads 11 and lower grid 6.

5. Transport and/or stroage equipment as claimed in claim 3 characterized by having lattice basket(s) 12 built in for the positioning of the radioactive object(s) 8 within the container 1.

6. Transport and/or storage equipment as claimed in claim 3 characterized by providing the container 1 with supproting columns 19 and lifting lugs 20, as well as with base 17.

7. Transport and/or storage equipment as claimed in claim 3 characterized by having a withdrawable dustproof cover 21 inside below the fitting plane of the container 1 and cover 2.

8. Embodiment of the equipment for transportation as claimed in claim 1 characterized by providing the basket 12 with a closable lattice lid 13.

9. Embodiment of the equipment for transportation as claimed in claim 3, characterized by having the basket 12 fixed to the inner reinforcing frame 14 of the container 1 with supporting springs 15 protected with rubber bell.

10. Embodiment of the equipment for transportation as claimed in claim 3 characterized by having a levelling trough 16 build into the upper part of the container.

11. Embodiment of the equipment for storage as claimed in claim 3 characterized by having activity-checking stubs 27 on the cover 2.

12. Embodiment of the equipment for storage as claimed in claim 3 characterized by having a space formed between the container 1 and storage shaft 26 for the gas flow ensuring the cooling of the container.

13. Embodiment of the equipment for storage as claimed in claim 12, characterized by having a gas distributor 22, gas inlet duct 23, gas outlet duct 24 and gas collector 25 formed in the concrete shaft 26.

* * * * *